US010772383B1

(12) United States Patent
Allen

(10) Patent No.: US 10,772,383 B1
(45) Date of Patent: Sep. 15, 2020

(54) SHOE ORNAMENT

(71) Applicant: John Allen, Youngstown, OH (US)

(72) Inventor: John Allen, Youngstown, OH (US)

( * ) Notice: Subject to any disclaimer, the term of this patent is extended or adjusted under 35 U.S.C. 154(b) by 224 days.

(21) Appl. No.: 15/973,666

(22) Filed: May 8, 2018

(51) Int. Cl.
*A43B 23/24* (2006.01)
*A41D 27/08* (2006.01)

(52) U.S. Cl.
CPC ..... *A43B 23/24* (2013.01); *A41D 27/08* (2013.01)

(58) Field of Classification Search
CPC ..... A43B 23/24; A43B 23/25; A43C 11/24; A43C 11/04; A43C 11/008; A43C 7/06; A41D 27/08; A41D 29/00; A41D 17/005; A41D 2200/00; A41D 2300/324; A41D 2300/33; A41B 7/04; A41B 7/06; A44B 5/00; A44B 6/00; A44C 15/0085; A44C 15/009; A41F 1/004; A41F 9/002
USPC ..... 2/245, 244, 124, 60; 36/136
See application file for complete search history.

(56) References Cited

U.S. PATENT DOCUMENTS 618,569 A * 1/1899 Gue ..... A41B 7/00 2/124
1,690,694 A * 11/1928 Nissen ..... A41F 19/005 24/199
2,088,872 A * 8/1937 Ruben ..... A41D 29/00 2/246
2,363,814 A * 11/1944 Stanton ..... A41D 29/00 2/246
2,871,602 A 2/1959 Uldall
2,888,767 A * 6/1959 Pinkus ..... A43B 23/24 2/245
D532,596 S 11/2006 Choi
8,069,538 B2 12/2011 Wilcox
8,104,198 B2 1/2012 Barras
9,474,329 B1 10/2016 Harvey
2010/0088926 A1 4/2010 Hirschfeld
2013/0019381 A1* 1/2013 Lovell ..... A43B 23/24 2/245
2013/0025164 A1 1/2013 Euresti
2013/0074545 A1* 3/2013 Moloney ..... A43B 23/24 63/3.1
2015/0096109 A1* 4/2015 Nackowski ..... A43B 23/24 2/245
2015/0128454 A1* 5/2015 Sykes ..... A43B 23/24 36/136
2015/0230556 A1* 8/2015 Simmons ..... A43B 23/24 36/136
2015/0272276 A1 10/2015 Brown
2015/0296904 A1* 10/2015 Darmetko ..... A41D 20/00 2/170
2017/0035126 A1* 2/2017 O'Leary ..... A44B 1/34
2017/0265569 A1* 9/2017 Reid ..... A43C 5/00

* cited by examiner

*Primary Examiner* — Amy Vanatta

(57) ABSTRACT

The shoe ornament is configured for use with footwear. The shoe ornament attaches to the upper of the footwear. The shoe ornament comprises one or more straps, a plurality of fasteners, and a plurality of cufflinks. The plurality of cufflinks and the plurality of fasteners attach the one or more straps to the footwear. Each cufflink selected from the plurality of cufflinks attaches a subset of straps selected from the one or more straps to a fastener selected from the plurality of fasteners. Each of the plurality of fasteners attaches to the upper of the footwear.

10 Claims, 4 Drawing Sheets

SHOE ORNAMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including footwear, more specifically, an ornament without a fastening function for footwear that further comprises a ribbon.

SUMMARY OF INVENTION

The shoe ornament is configured for use with footwear. The shoe ornament attaches to the upper of the footwear. The shoe ornament comprises one or more straps, a plurality of fasteners, and a plurality of cufflinks. The plurality of cufflinks and the plurality of fasteners attach the one or more straps to the footwear. Each cufflink selected from the plurality of cufflinks attaches a subset of straps selected from the one or more straps to a fastener selected from the plurality of fasteners. Each of the plurality of fasteners attaches to the upper of the footwear.

These together with additional objects, features and advantages of the shoe ornament will be readily apparent to those of ordinary skill in the art upon reading the following detailed description of the presently preferred, but nonetheless illustrative, embodiments when taken in conjunction with the accompanying drawings.

In this respect, before explaining the current embodiments of the shoe ornament in detail, it is to be understood that the shoe ornament is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shoe ornament.

It is therefore important that the claims be regarded as including such equivalent construction insofar as they do not depart from the spirit and scope of the shoe ornament. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preffered or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
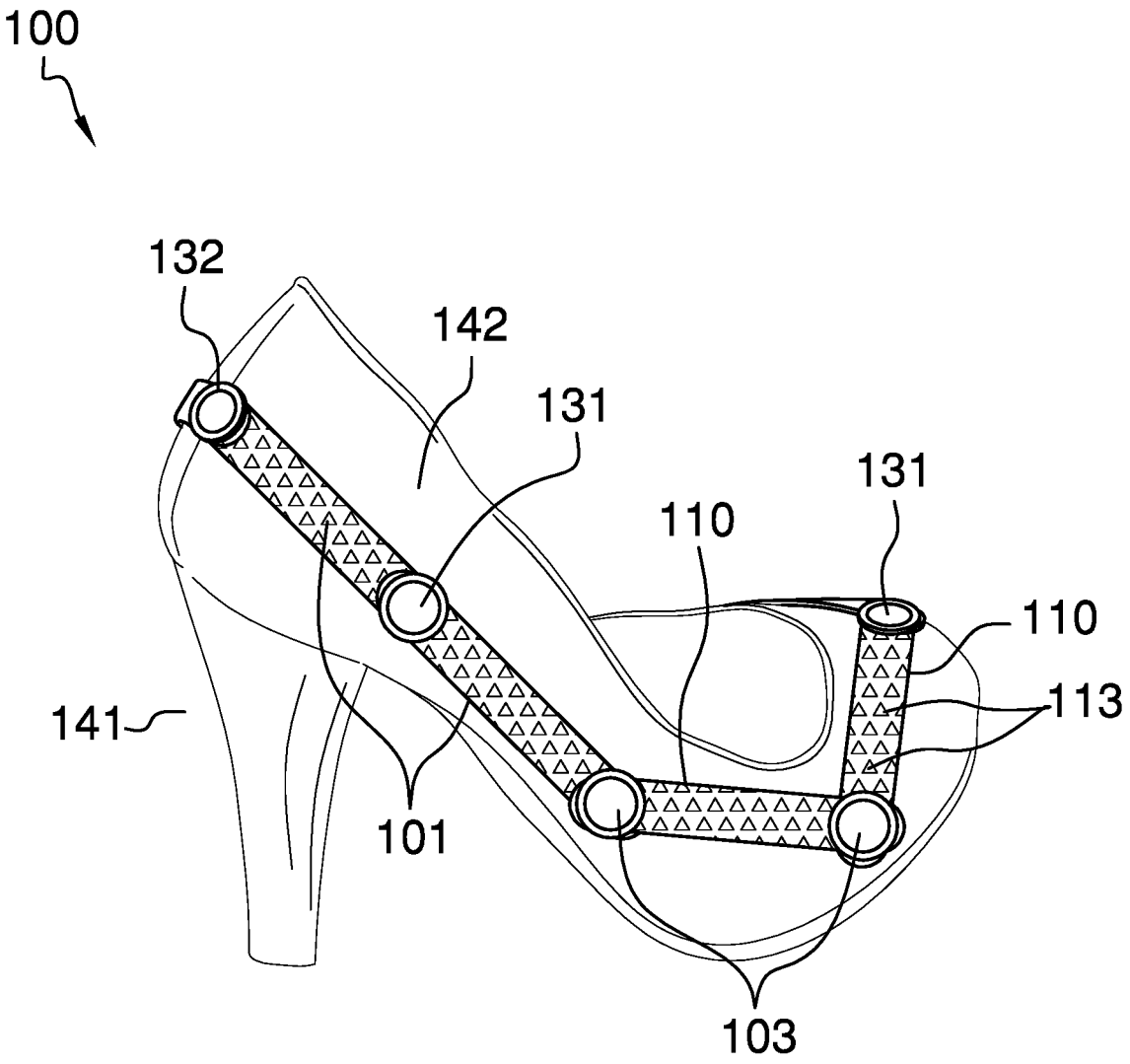
FIG. 1 is a perspective view of an embodiment of the disclosure.
Figure 2:
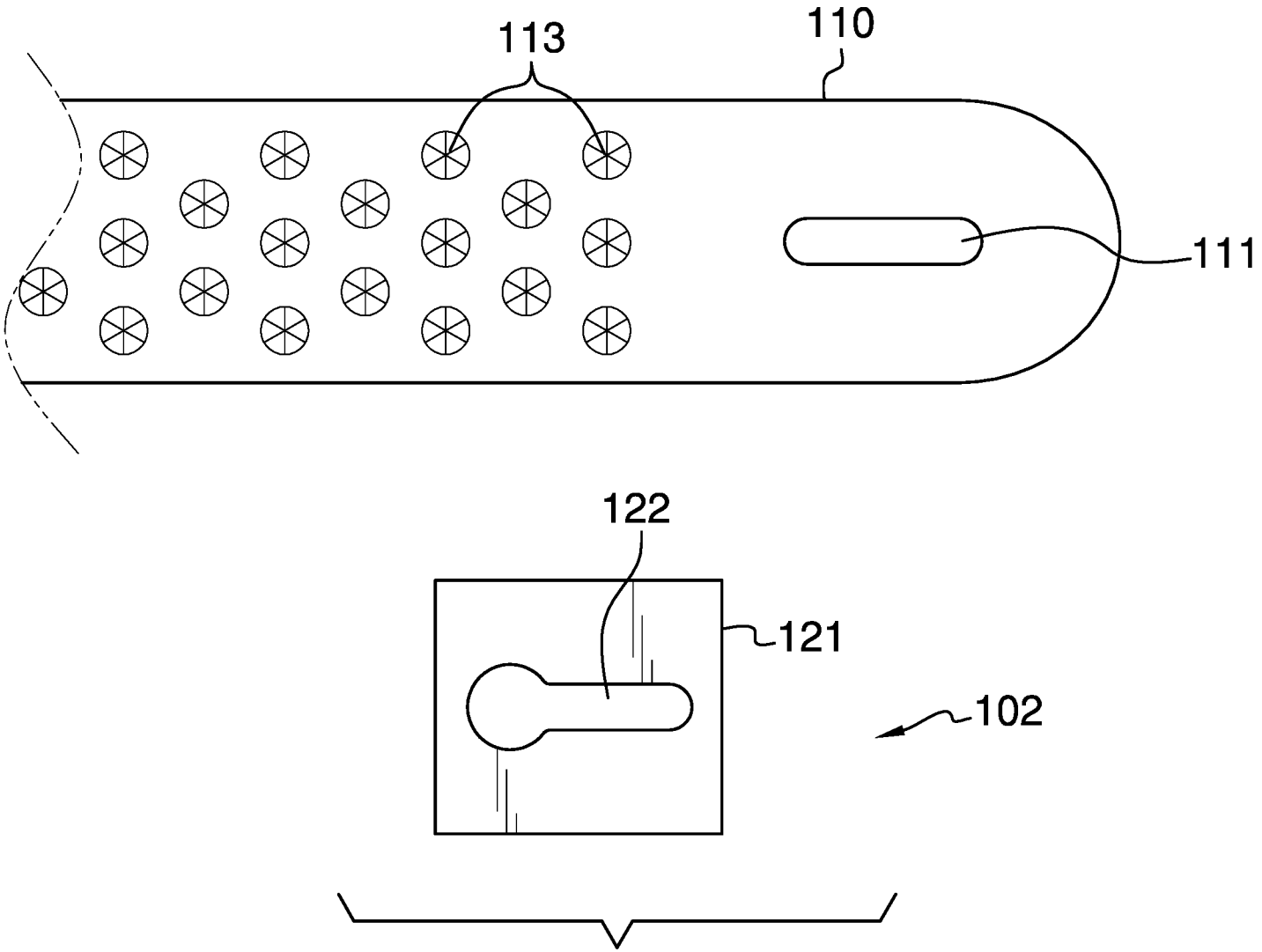
FIG. 2 is a detail view of an embodiment of the disclosure.
Figure 3:
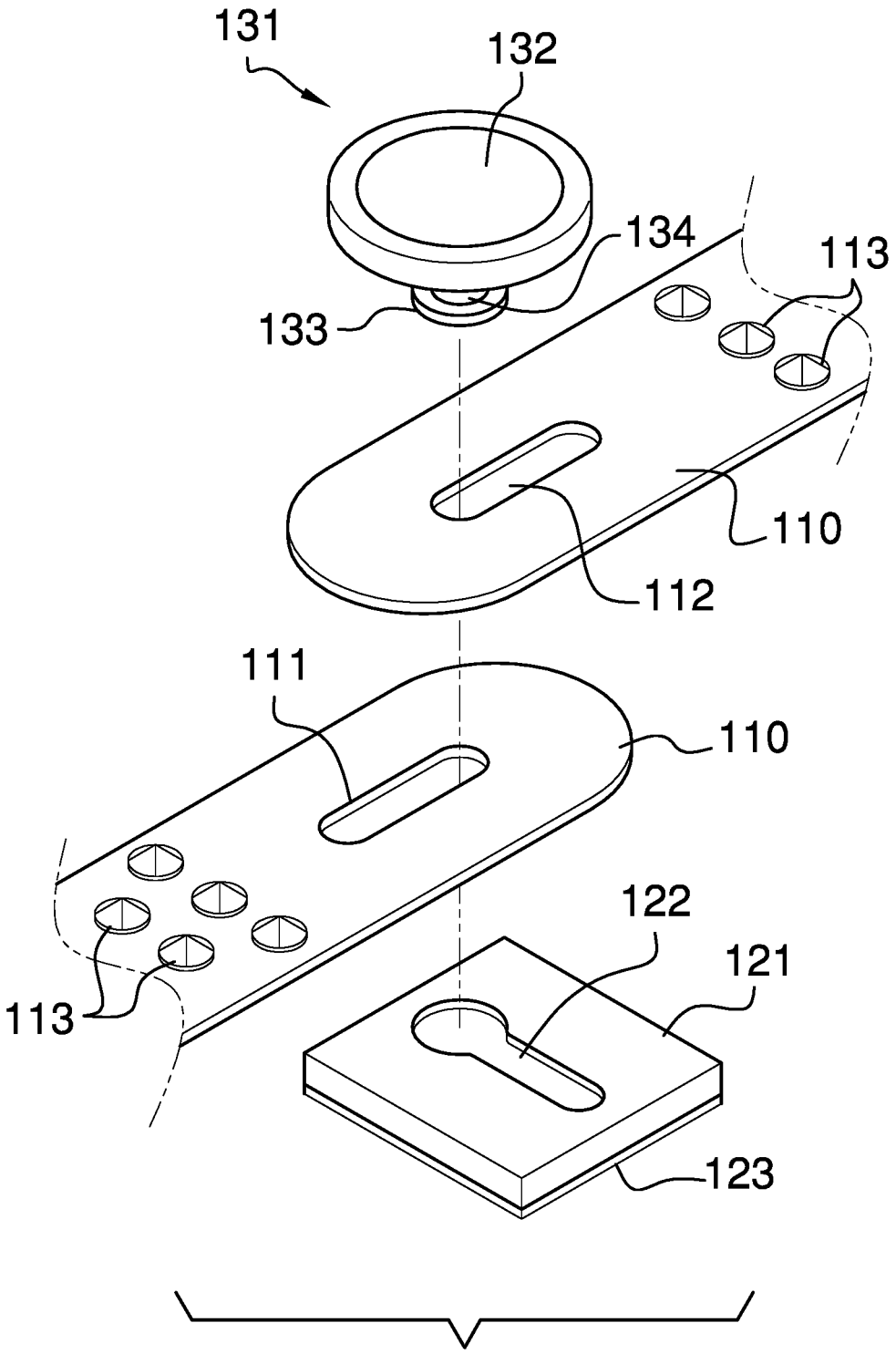
FIG. 3 is an exploded view of an embodiment of the disclosure.
Figure 4:
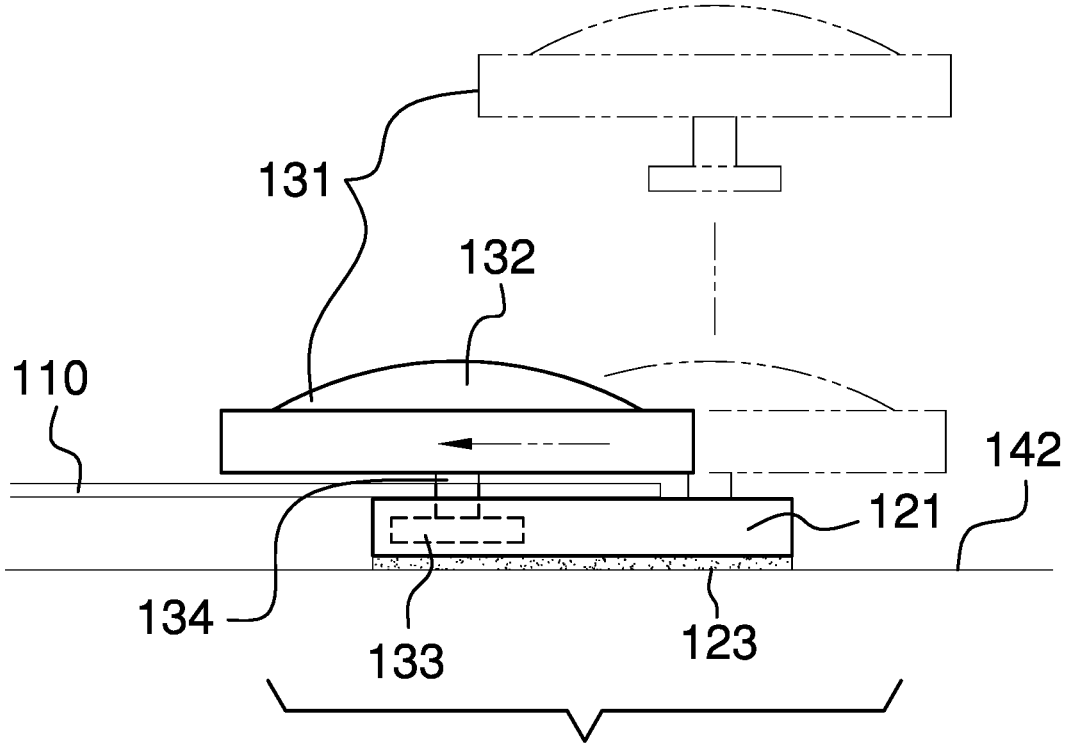
FIG. 4 is a side view of an embodiment of the disclosure.

Detailed reference will now be made to one or more potential embodiments of the disclosure, which are illustrated in FIGS. 1 through 4.

The shoe ornament 100 (hereinafter invention) is configured for use with footwear 141. The footwear 141 is further defined with an upper 142. The invention 100 attaches to the upper 142 of the footwear 141. The invention 100 comprises one or more straps 101, a plurality of fasteners 102, and a plurality of cufflinks 103. The plurality of cufflinks 103 and the plurality of fasteners 102 attach the one or more straps 101 to the footwear 141. Each individual cufflink 131 selected from the plurality of cufflinks 103 attaches a subset of straps selected from the one or more straps 101 to a fastener selected from the plurality of fasteners 102. Each of the plurality of fasteners 102 attaches to the upper 142 of the footwear 141.

Each of the one or more straps 101 is a decorative element of the invention 100. Each of the one or more straps 101 is an individual webbing 110 that is displayed on the exterior surface of the upper 142 of the footwear 141. The one or more straps 101 comprises a collection of individual webbings 110. Each individual webbing 110 further comprises a first buttonhole 111, a second buttonhole 112 and decorative findings 113.

The individual webbing 110 is a commercially available textile webbing. The manufacture and use of textile webbings are well known and documented in the textile arts.

The first buttonhole 111 is a buttonhole formed in a first end of the individual webbing 110. The first buttonhole 111 is sized to receive an individual cufflink 131 selected from the plurality of cufflinks 103. A first individual cufflink 131 attaches the individual webbing 110 to a first fastener selected from the plurality of fasteners 102 through the first buttonhole 111.

The second buttonhole 112 is a buttonhole formed in the end of the individual webbing 110 that is distal from the first buttonhole 111. The second buttonhole 112 is sized to receive an individual cufflink 131 selected from the plurality of cufflinks 103. The second buttonhole 112 attaches the individual webbing 110 to a second fastener selected from the plurality of fasteners 102 through the second buttonhole 112. A second individual cufflink 131 attaches the individual webbing 110 to a second fastener selected from the plurality of fasteners 102 through the second buttonhole 112.

Each individual webbing 110 attaches to the upper 142 of the footwear 141 using both the first buttonhole 111 and the second buttonhole 112.

The decorative findings 113 comprises a collection of decorative elements that are attached to the individual webbing 110. Suitable decorative findings 113 include, but are not limited to, printed images, sequins, and costume jewelry.

Each of the plurality of fasteners 102 is a structure that attaches directly to the upper 142 of the footwear 141. Each of the plurality of fasteners 102 forms an anchor point to which a subset of individual webbings 110 selected from the one or more straps 101 attach. The plurality of fasteners 102 comprises a collection of individual containment structures 121.

Each individual containment structure 121 is a hollow disk structure. Each individual containment structure 121 is a prism-shaped structure. Each individual cufflink 131 selected from the plurality of cufflinks 103 attaches a subset of individual webbings 110 selected from the one or more straps 101 to the individual containment structure 121. Each individual containment structure 121 further comprises a keyhole surface 122, and an adhesive surface 123.

The keyhole surface 122 is an end of the individual containment structure 121 that has a keyhole formed in it. The keyhole formed in the keyhole surface 122 is an aperture into which the individual cufflink 131 is inserted to attach the selected subset of individual webbings 110 to the individual containment structure 121.

The adhesive surface 123 is the end of the individual containment structure 121 that is distal from the keyhole surface 122. The adhesive surface 123 is coated with a removable adhesive. The adhesive surface 123 removably attaches the individual containment structure 121 directly to the upper 142 of the footwear 141.

Each of the plurality of cufflinks 103 is a fastening device. Each of the plurality of cufflinks 103 attaches a subset of individual webbings 110 selected from the one or more straps 101 to a fastener selected from the plurality of fasteners 102. Each of the plurality of cufflinks 103 further has a decorative function. The plurality of cufflinks 103 comprises a collection of individual cufflinks 131.

The individual cufflink 131 is a fastening device used to attach a first surface to a second surface. The individual cufflink 131 inserts through a buttonhole selected from the group consisting of the first buttonhole 111 and the second buttonhole 112 before being inserted through the keyhole surface 122 of the individual containment structure 121. Each individual cufflink 131 further comprises a decorative disk 132, a fastening disk 133, and an extension structure 134.

The decorative disk 132 is a disk-shaped structure that is visible from the exterior of the footwear 141 when the invention 100 is in use.

The fastening disk 133 is a disk-shaped structure. The fastening disk 133 attaches the individual cufflink 131 to the selected individual containment structure 121. The diameter of the fastening disk 133 is sized such that: 1) the fastening disk 133 can insert through the circular opening of the keyhole surface 122; and, 2) slide underneath the rectangular aperture of the keyhole surface 122; to, 3) attach the individual cufflink 131 to the selected individual containment structure 121. The diameter of the fastening disk 133 is greater than the span of the narrow end of the rectangular portion of the keyhole formed in the keyhole surface 122.

The extension structure 134 is a prism-shaped post that attaches the decorative disk 132 to the fastening disk 133. The decorative disk 132 and the fastening disk 133 attach to the opposite ends of the extension structure 134. The diameter of the extension structure 134 is sized such that the extension structure 134 fits through the rectangular opening of the keyhole surface 122.

This paragraph describes the use of the invention 100. Each adhesive surface 123 of the plurality of fasteners 102 is placed against the upper 142 of the footwear 141. The fastening disk 133 of each of the plurality of cufflinks 103 inserts through a buttonhole of a subset of individual webbings 110 selected from the one or more straps 101. The buttonhole is selected from the group consisting of the first buttonhole 111 and the second buttonhole 112. The fastening disk 133 attaches the selected subset of individual webbing 110 by being inserted through the circular aperture and slid under the rectangular aperture of the keyhole surface 122 of the individual containment structure 121. This process repeats until: 1) each buttonhole of each individual webbing 110 is attached to an individual containment structure 121; 2) each individual cufflink 131 is attached to an individual containment structure 121; and, 3) each individual containment structure 121 has an individual cufflink 131 attached to it.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Anchor: As used in this disclosure, anchor means to hold an object firmly or securely.

Anchor Point: As used in this disclosure, an anchor point is a location to which a first object can be securely attached to a second object.

Buttonhole: As used in this disclosure, a buttonhole refers to a slit formed in a textile. The buttonholes are used to secure two or more textiles together using a cufflink or a button.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Coating: As used in this disclosure, a coating refers to a substance applied to the exterior surface of an object such that the coating forms a new exterior surface of the object. A coating is commonly said to be formed as a layer. Paint is an example of a common coating material.

Cufflink: As used in this disclosure, a cufflink refers to a finding made of two disk-like objects separated by an extension structure.

Decorative: As used in this disclosure, decorative is an adjective that refers to a first object or item used with a second object or item to make the second object or item more attractive. Decorative will generally, but not necessarily, implies making the second object or item more attractive visually.

Diameter: As used in this disclosure, a diameter of an object is a straight line segment (or a radial line) that passes through the center (or center axis) of an object. The line segment of the diameter terminates at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance.

Extension Structure: As used in this disclosure, an extension structure is an inert physical structure that is used to extend the span of the distance between any two objects.

Findings: As used in this disclosure, findings are small decorative elements, fasteners, or tools for fit, function, or adjustment that are used with apparel or footwear.

Footwear: As used in this disclosure, footwear refers to a protective structure worn on a foot. Footwear is often referred to as a shoe.

Image: As used in this disclosure, an image is an optical representation or reproduction of an indicia or of the appearance of something or someone.

Keyhole: As used in this disclosure, a keyhole refers to an aperture formed through a surface. The keyhole has a characteristic shape of a rectangle with a circle located at the narrow end of the rectangle. The diameter of the circle is greater than the span of the narrow end of the rectangle. The keyhole is used to secure an object to the surface. Specifically, the object has a disk shape mounted on an extension structure. The diameter of the disk is less than the diameter of the circle such that the disk will insert through the circle. The diameter of the disk is greater than the span of the narrow end of the rectangle such when the disk is slid underneath the rectangle the disk will not pass through the rectangle thereby securing the object to the surface. The size of the extension structure is selected such that the extension will slide into the rectangle. Use diameter, extension structure, disk, and cylinder.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Removable Adhesive: As used in this disclosure, a removable adhesive is a commercially available adhesive that is designed with a lower tack, or stickiness, such that a first object is attached to a second object with a removable adhesive the first object can be readily removed in a manner that ideally, though not necessarily practically, leaves behind no adhesive residue on the second object. A repositionable adhesive is a subset of removable adhesives that are intended to allow the first object to be reattached to a third object or the second object in the initial or a different position. Within this disclosure, a removable adhesive is assumed to include repositionable adhesives.

Slit: As used in this disclosure, a slit is a long narrow cut or opening formed in or through an object.

Sole: As used in this disclosure, the sole component of footwear that forms the undersurface of the footwear and comes in contact with the ground.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Subset: As used in this disclosure, a subset refers to one or more objects selected from a previously specified set of objects.

Textile: As used in this disclosure, a textile is a material that is woven, knitted, braided or felted. Synonyms in common usage for this definition include fabric and cloth.

Upper: As used in this disclosure, the upper is the portion of footwear that is above the sole.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A decorative structure comprising:

one or more straps, a plurality of fasteners, and a plurality of cufflinks;

wherein the decorative structure is configured for use with footwear;

wherein the footwear is further defined with an upper;

wherein the decorative structure attaches to the upper of the footwear;

wherein the plurality of cufflinks and the plurality of fasteners attach the one or more straps to the footwear;

wherein each individual cufflink selected from the plurality of cufflinks attaches a subset of straps selected from the one or more straps to a fastener selected from the plurality of fasteners;

wherein each of the plurality of fasteners is a structure that attaches directly to the upper of the footwear;

wherein each of the plurality of fasteners forms an anchor point to which a subset of individual webbings selected from the one or more straps attach;

wherein each of the plurality of cufflinks is a fastening device;

wherein each of the plurality of cufflinks attaches a subset of individual webbings selected from the one or more straps to a fastener selected from the plurality of fasteners;

wherein each of the one or more straps is further defined as an individual webbing;

wherein each individual webbing is displayed on the exterior surface of the upper of the footwear;

wherein each individual webbing is a textile webbing;

wherein each individual webbing comprises a first buttonhole, a second buttonhole, and decorative findings;

wherein the first buttonhole is a buttonhole formed in a first end of the individual webbing;

wherein the first buttonhole is sized to receive an individual cufflink selected from the plurality of cufflinks;

wherein the first buttonhole attaches the individual webbing to a first fastener selected from the plurality of fasteners;

wherein the second buttonhole is a buttonhole formed in an end of the individual webbing that is distal from the first buttonhole;

wherein the second buttonhole is sized to receive an individual cufflink selected from the plurality of cufflinks;

wherein the second buttonhole attaches the individual webbing to a second fastener selected from the plurality of fasteners;

wherein each individual webbing attaches to the upper of the footwear using both the first buttonhole and the second buttonhole;

wherein the decorative findings comprises a collection of decorative elements that are attached to the individual webbing;

wherein the decorative findings are selected from the group consisting of printed images, sequins, and costume jewelry;

wherein the plurality of fasteners comprises a collection of individual containment structures;

wherein each individual containment structure is a hollow disk structure;

wherein each individual containment structure is a prism-shaped structure.

2. The decorative structure according to claim 1 wherein each individual containment structure further comprises a keyhole surface, and an adhesive surface;

wherein the keyhole surface is an end of the individual containment structure that has a keyhole formed in it;

wherein the adhesive surface is an end of the individual containment structure that is distal from the keyhole surface.

3. The decorative structure according to claim 2 wherein the keyhole formed in the keyhole surface is an aperture into which the individual cufflink inserts.

4. The decorative structure according to claim 3 wherein the adhesive surface is coated with a removable adhesive;

wherein the adhesive surface removably attaches the individual containment structure directly to the upper of the footwear.

5. The decorative structure according to claim 4 wherein the plurality of cufflinks comprises a collection of individual cufflinks;

wherein the individual cufflink is a fastening device;

wherein the individual cufflink inserts through a buttonhole selected from the group consisting of the first buttonhole and the second buttonhole before being inserted through the keyhole surface of the individual containment structure.

6. The decorative structure according to claim 5 wherein each individual cufflink selected from the plurality of cufflinks attaches a subset of individual webbings selected from the one or more straps to the individual containment structure.

7. The decorative structure according to claim 6 wherein each individual cufflink further comprises a decorative disk, a fastening disk, and an extension structure;

wherein the extension structure attaches the decorative disk to the fastening disk.

8. The decorative structure according to claim 7 wherein the decorative disk is a disk-shaped structure;

wherein the decorative disk is visible from the exterior of the footwear;

wherein the fastening disk is a disk-shaped structure;

wherein the fastening disk attaches the individual cufflink to a selected individual containment structure.

9. The decorative structure according to claim 8 wherein the diameter of the fastening disk is sized such that the fastening disk inserts through a circular opening of the keyhole surface;

wherein the diameter of the fastening disk is sized such that the fastening disk slides underneath the rectangular aperture of the keyhole surface;

wherein the diameter of the fastening disk is greater than the span of a narrow end of a rectangular portion of the keyhole formed in the keyhole surface.

10. The decorative structure according to claim 9 wherein the extension structure is a prism-shaped post;

wherein the decorative disk and the fastening disk attach to opposite ends of the extension structure;

wherein a diameter of the extension structure is sized such that the extension structure fits through the rectangular opening of the keyhole surface.

* * * * *